US006581428B1

(12) United States Patent
Friedman

(10) Patent No.: US 6,581,428 B1
(45) Date of Patent: Jun. 24, 2003

(54) METHOD AND APPARATUS FOR SUPERPLASTIC FORMING

(75) Inventor: Peter A. Friedman, Ann Arbor, MI (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 09/683,610

(22) Filed: Jan. 24, 2002

(51) Int. Cl.[7] ..... B21D 26/02
(52) U.S. Cl. ..... 72/57; 72/60; 29/421.1
(58) Field of Search ..... 72/60, 57, 63; 29/421.1

(56) References Cited

U.S. PATENT DOCUMENTS 3,373,585 A * 3/1968 Reynolds ..... 72/57
4,113,522 A 9/1978 Hamilton et al.
4,951,491 A 8/1990 Lorenz
5,467,626 A * 11/1995 Sanders ..... 72/60
5,974,847 A 11/1999 Saunders et al.
6,047,583 A 4/2000 Schroth
6,085,571 A 7/2000 Brinas et al.
6,098,438 A * 8/2000 Fischer ..... 72/60
6,253,588 B1 7/2001 Rashid et al.
6,305,202 B1 * 10/2001 Kleber ..... 72/57

* cited by examiner

*Primary Examiner*—David Jones
(74) *Attorney, Agent, or Firm*—Raymond L. Coppiellie

(57) ABSTRACT

The present invention provides a method and apparatus for forming a sheet of ductile material by superplastic forming. Excessive wrinkling is prevented in the present invention by providing a method and apparatus which controls the amount of material flow during the forming process.

15 Claims, 4 Drawing Sheets

METHOD AND APPARATUS FOR SUPERPLASTIC FORMING

BACKGROUND OF INVENTION

The present invention relates generally to forming of materials, and more particularly to a method and apparatus for the superplastic forming of materials, the method and apparatus including a preforming operation.

Superplastic alloys have long been known to exhibit large strains to failure and strong resistance to necking during tensile elongation. Superplastic forming ("SPF") has been developed as an effective way to form such alloys and offers several advantages over conventional stamping techniques including increased formability, zero springback, and low tooling costs. The large degree of plastic strain that can be achieved with this process (>200%) makes it possible to form complex parts that cannot be shaped with conventional stamping techniques. These alloys can be formed with relatively low forces and they permit a high level of detail in the stamping design.

Typical superplastic forming takes place in a simple one-sided, single action tool. The blank is clamped in a heated die and then blow formed with gas pressure into a female die. The part detail is captured within a single die rather than a matched pair and therefore tooling is significantly less expensive than that of conventional stamping. Furthermore, the low forces needed to form the material at these elevated temperatures allows for the use of cast iron dies instead of the harder to work and more expensive tool steel.

While superplastic forming may be a viable manufacturing option for some parts, there are limitations in the economic feasibility of this technique. Superplastic response in metals is inherently coupled with the rate of deformation and there exists only a narrow range of strain rates, typically slow strain rates, in which these materials display superplastic response. This results in a relatively slow cycle time which often leaves superplastic forming as a cost prohibitive option for high volume parts.

Another problem related to SPF stems from the inability to draw material into the die cavity. Although the superplastic material utilized in SPF can undergo substantial deformation, its formability is limited to the amount of material in the die. After the die faces are clamped and sealed, additional superplastic material cannot be drawn into the die. This may result in tears or inconsistent wall thickness in the part being formed. To overcome this, U.S. Pat. No. 5,974,847 introduces preforming the material around a punch before gas pressure sealing the dies and completing the forming process by gas pressure injection. This approach reduces the amount of superplastic forming that takes place thereby reducing the cycle time and potentially allowing greater design freedom due to the additional material drawn into the die during the preforming step. While the method of this patent teaches preforming the material before the gas is injected, the method does not restrain the material entering the die during the preforming step. Without a restraining force on the material, such as blankholder force, the material will wrinkle around the punch in all but the simplest of formings. Wrinkling of the material during preforming will result in either the inability to complete the part during subsequent gas pressure forming or, at best, a low quality finished part.

Therefore, there exists a need for a method of forming superplastic materials which controls the amount of material to be drawn into the die cavity during a preforming process so as to avoid wrinkling of the material. The present invention provides such a need by controlling the material flow into the die during the preforming step, thereby eliminating wrinkles in the preformed part. An apparatus to adjust the amount of material flowing into the die is also necessary to ensure uniform preform wall thicknesses and high quality preformed parts. These preforms will lead to more consistent finished parts and will assist in increasing the speed of the forming process.

SUMMARY OF THE INVENTION

It is an advantage of the present invention to provide a method of superplastic forming which increases forming speed while reducing surface defects in the formed part.

It is another advantage of the present invention to provide a method of reducing tooling cost by using one-sided cast iron dies and providing a universal lower die system that can be used to form a variety of parts.

It is another advantage of the present invention to provide a method of restraining the sheet during the preforming step so as to produce a blankholder effect that prevents wrinkling of the sheet.

The present invention provides these advantages by providing a method of shaping a metal sheet into a formed product, comprising the steps of providing a first and second die member operative to move between a first open position and a second sealed position such that a die cavity is formed; providing a preforming punch disposed on one of the die members; providing a metal sheet of ductile material; and providing a blankholder engagable with a cushion system operative to move between a first material loading position and a second material loaded position. The method further comprises the steps of heating the die members and the preforming punch to a predetermined temperature, heating the metal sheet to a predetermined material forming temperature and moving the first and second die members to the open position and the blankholder to the material loading position. The method then continues with the steps of placing the metal sheet into the blankholder, moving a die member to engage the blankholder until the metal sheet contacts the preforming punch. The method further includes the steps of moving a die member, the blankholder, and the metal sheet until the die member sealed position is reached, controlling the amount of material flow into the die cavity as the metal sheet is over the preforming punch and applying gas pressure to the metal sheet after the sealed position is reached and until forming of the product is completed. Once completed, the die members are opened and the finished part removed.

The present invention further provides an apparatus for use with the method of the present invention, the apparatus comprising at least two die members operative to move between a first open position and second sealed position such that a die cavity is formed; a preforming punch disposed upon one of the die members, a cushioning system operative to control the amount of material flow into the die cavity as the metal sheet is formed over the preforming punch and a blankholder engagable with the cushion system. The apparatus further comprises a heating platen operative to raise the temperature of the die members to a predetermined level; a source of gas pressure and passages for directing the gas pressure into the die cavity; and wherein the cushioning system exerts a force on the metal sheet holding the metal sheet in place and permitting controlled material flow into the die until the second sealed position is reached. The present invention provides these advantages by utilizing a die cushioning system to control material flow into the die cavity during the preforming step reducing wrinkling in the preform and finished part.

These and other advantages of the present invention will become readily apparent by the drawings, detailed description and claims that follow.

DETAILED DESCRIPTION

Figure 1:
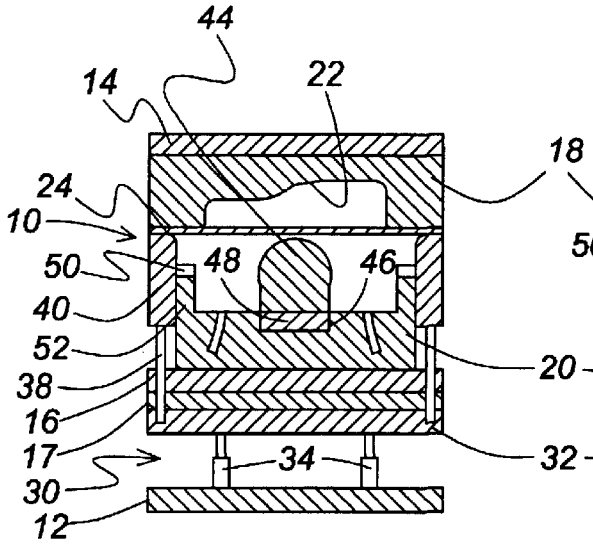
FIGS. 1–4 are cross-sectional views illustrating the relative positions of the apparatus of the present invention, the metal sheet, and the die cavities during the three forming steps utilized in the superplastic forming process of the present invention.

Referring now to the drawings, FIGS. 1–4 show an apparatus 10 for superplastic forming of a sheet of highly ductile material in accordance with the present invention. The superplastic forming apparatus 10 includes a frame 12 housing an upper platen 14, lower platen 16, an upper die 18 and a lower die 20. As illustrated, the upper 18 includes a forming surface 22 against which a sheet 24 of ductile material is pressed to form the final shape of a workpiece to be formed. In an alternative configuration, the forming surface could be located in the lower die. Because the material to be formed must be highly ductile, forming typically takes place at elevated temperatures. Both of the dies 18, 20 and the material must be heated to a predetermined temperature prior to forming. This predetermined temperature depends on the composition of the alloy to be formed. To heat the dies, the upper 14 and lower 16 platens are heated, such as by electrical resistance, and pass this heat to each of the dies. The lower platen 16 is disposed adjacent a cooling plate 17 which acts to prevent the heat from passing below the lower die 20 to heat sensitive components of the forming apparatus 10. A typical material to be formed in the forming apparatus 10 of the present invention is an aluminum alloy, such as alloy 5083. This aluminum alloy has a nominal composition, by weight, of 4 to 4.9% manganese, 0.05 to 0.25% chromium, about 0.1% copper and the balance aluminum. This alloy would be formed at a temperature of approximately 500° C.

Figure 5:
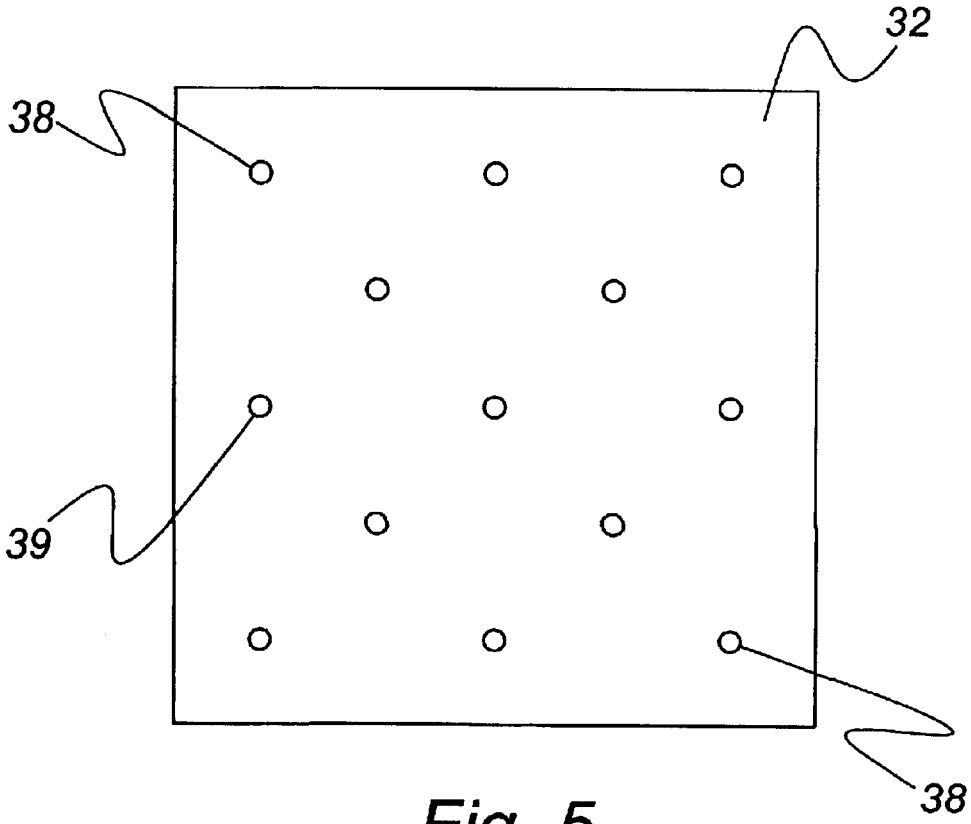
FIG. 5 is a plan view of a cushion plate of the present invention.

The forming apparatus 10 further includes a cushion system 30 disposed at the base of the frame 12. As will be described in more detail below, the cushion system operates to restrain the material 24 flowing into the die by producing a blankholder force. The cushion system includes a cushion plate 32 and a pair of nitrogen cylinders 34 disposed between the frame 12 and the cushion plate 32. Two cylinders are shown, but it is contemplated that more cylinders can be used, depending on the need and application. Alternatively, coil springs or other such resistive devices can be used. The cushion system 30 further includes cushion pins 38 which pass through lower platen 16 and cooling plate 17 and which include cushion posts or blankholders 40 disposed on a free end thereof. In operation, the sheet 24 is placed on the blankholders 40 prior to the forming operation. FIG. 5 shows a top view of the cushion plate 32 and the respective cushion pin 38 arrangement. Cushion plate 32 includes a plurality of apertures 39 through which the cushion pins 38 can pass. By providing a plurality of these apertures, the plate 32 can be used for a variety of tool configurations. Cushion pins 38 pass through the heated lower platen 16 and the cooling plate 17 before their loads are transferred into the blankholder 40. Positioning the cushion pins 38 in this manner avoids the heating and cooling piping imbedded in lower platen 16 and cooling plate 17. This design also allows the same plate to be used for different die designs by inserting or removing the cushion pins 38 into the cushion plate 32.

A preform punch 44 is disposed in the lower die 20. The preform punch 44 is disposed in a recess 46 formed in the die 20. Shims 48 may be placed between the punch 44 and the recess 46 to raise to position of the punch, depending on the forming application. The punch 44 can take a variety of different configurations depending on the final shape of the workpiece. The punch may also be placed in the upper die 18 in an alternative embodiment.

Lower die 20 also includes a plurality of gas passages 49 that provide pressurized gas used in the forming process. Lower die further includes a gas pressure seal 50 disposed on the mating end 52 of the die 20. As will be described below, the gas pressure seal performs two functions: the seal prevents pressurized gas from leaking during forming, and in cooperation with upper die 18, holds the sheet 24 in position during forming. The seal 50 can be formed integrally on the ends of the lower die 20 or secured there in a known manner, such as by welding. The seal 50 is shaped so that it matingly engages a mirror shape formed in or attached to the upper die 18. In this way, gas pressure cannot escape the die cavity when the upper and lower dies are closed together in a sealed position.

Figure 2:
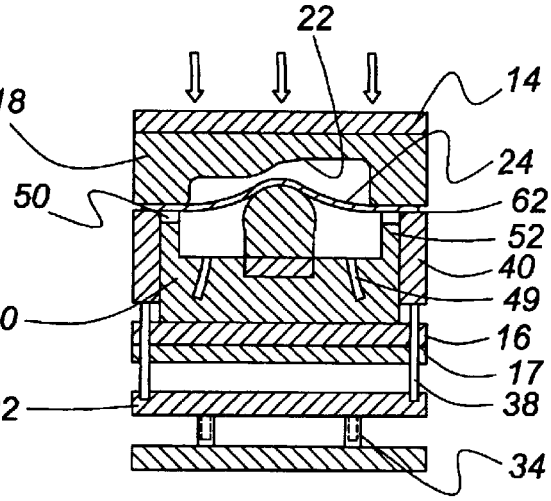

A method of superplastic forming the sheet 24 of ductile material using the apparatus 10 of the present invention will now be described. Referring again to the drawings, FIGS. 1–4 show the progression of steps of the forming process in accordance with the method of the present invention. Prior to these steps, the upper 14 and lower 16 platens heat the upper and lower dies, respectively, to a predetermined temperature. The sheet 24 to be formed is also heated to this forming temperature. In FIG. 1, the sheet 24 of ductile material is loaded into the blankholder 40 in the material loading position. Movement of the dies into the second sealed position is shown in FIG. 2 wherein the upper die 18 is lowered until it contacts the sheet 24 and shapes the sheet 24 around the preforming punch 44. The amount of deformation induced in this step is controlled by the relative height of the punch 44 to the height of the gas pressure seal 50. This can be altered by either changing the punch within the lower die or by changing the height of the punch with the shimming system 48 within the lower die 20. While the upper die 18 moves down into the second sealed position, the blankholder 40 exerts a controlled upward force on the sheet 24 permitting the sheet 24 to flow into the die cavity during the preforming operation. The flow of the sheet 24 into the die cavity can be seen at reference numeral 60, wherein the ends 62 of the sheet 24 are spaced a distance from the ends of the blankholder 40. Consequently, the amount of sheet material 24 drawn into the die cavity during this preforming stage is directly related to the amount of extensive force produced by the nitrogen cylinders 34. The rate in which the sheet material 24 is allowed to draw-in over the blankholder 40 is controlled by the force in the cushion system 30. This cushion force is a critical element to control the draw-in process and prevent either splits (too much force) or wrinkles (not enough force) on the end product.

Figure 3:
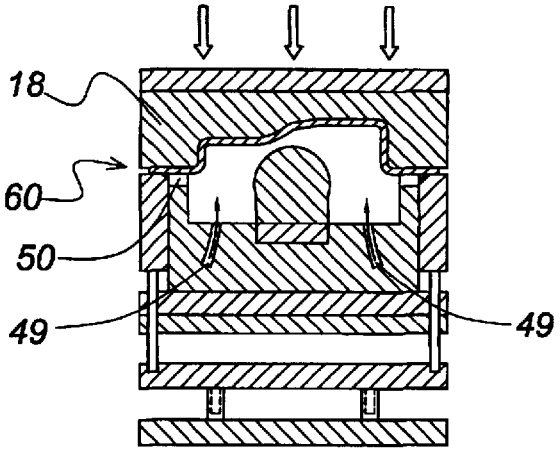

FIG. 3 shows the next step in the method of the present invention. Once the upper die 18 reached the gas pressure seal 50 on the lower die 20, the mechanical deformation is finished and the part can be forced into the upper die 18 with superplastic gas pressure. This is the die pressure sealed position in the method of the present invention. The cushion system 30 is no longer used when the upper die 18 descends and contacts the lower die 20. At this time a gas pressure seal 50 is created between the two dies 18 and 20, sandwiching the material 24 therebetween. This seal 50 holds the material in place while a high-pressure gas is injected into the underside of the material via the gas passages 49. This pressure forces the preformed material to conform to the surface of the upper die 18 producing the shape of the finished part. The gas pressure seal 50 ensures no gas leakage between the material and the lower die in addition to allowing no further material flow. During this step, the force on the upper die scales with the gas pressure to avoid gas leakage.

Figure 4:
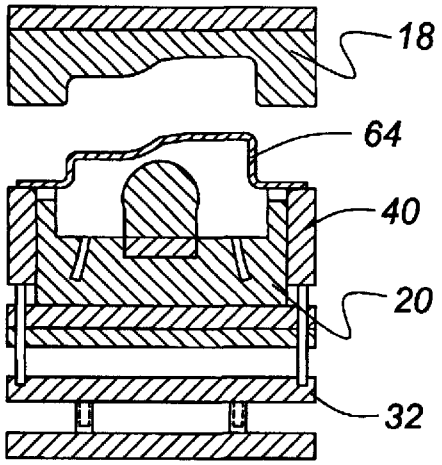

As shown in FIG. 4, after the part is completed, the gas pressure is released and the upper die 18 is raised to the open position so that the completed part can be removed from the lower die 20. The design of this die system allows for re-use of the bottom die system including bottom die 20, performing punch 44, blankholder 40 and cushion system 30. For example, four different door inners could be produced by just changing the upper die 18. The upper dies are relatively simple one-sided tools that can be fabricated from cast iron. This flexibility results in significant savings in tooling costs.

Figure 6:
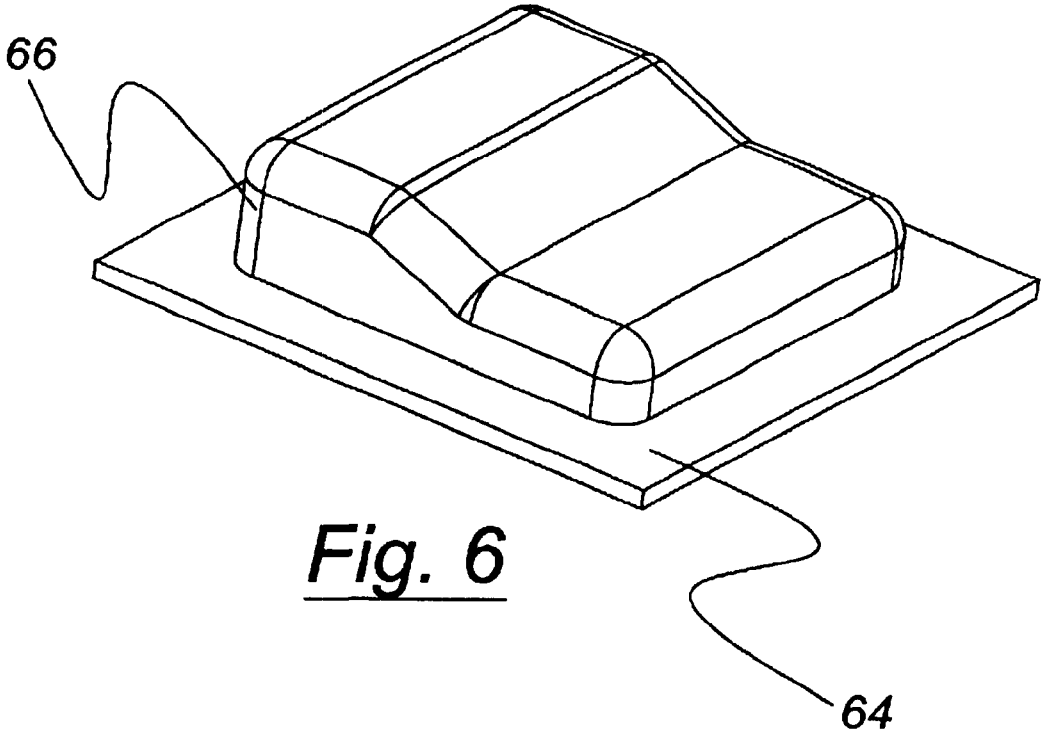
FIG. 6 is a perspective view of a preformed metal sheet formed using the method and apparatus of the present invention.

FIG. 6 illustrates a properly formed metal sheet 64 after it has been formed in the apparatus 10 according to the method of the present invention and removed from the die cavity. Without controlling the amount of sheet material flowing into the die cavity during the preforming step, this part would wrinkle around the punch and make it impossible to successfully complete the part with superplastic gas pressure.

It will be realized, however, that the foregoing specific embodiments have been shown and described for the purposes of illustrating the functional and structural principles of the invention and is subject to change without departure from such principles. Therefore, this invention includes all modifications encompassed within the scope of the following claims.

What is claimed is:

1. A method of shaping a metal sheet into a formed product comprising the steps of:

providing a first and second die member operative to move between a first open position and a second sealed position such that a die cavity is formed;

providing a preforming punch disposed on one of the die members;

providing a metal sheet of ductile material;

providing a blankholder operative to move between a first material loading position and a second material loaded position;

providing a cushion system engageable with the blankholder and operative to exert a force against the blankholder and the first die member;

heating the die members and the preforming punch to a predetermined temperature;

heating the metal sheet to a predetermined material forming temperature;

moving the first and second die members to the open position and the blankholder to the material loading position;

placing the metal sheet into the blankholder;

moving a die member, the blankholder, and the metal sheet until the die member sealed position is reached;

controlling the amount of material flow into the die cavity as the metal sheet is formed over the preforming punch by adjusting the amount of pressure exerted by the cushion system against the blankholder and the first die member;

applying gas pressure to the metal sheet after the sealed position is reached and until forming of the product is completed;

moving the die members to the open position; and moving the blankholder to the material loading position and removing the formed product.

2. A method according to claim 1 wherein the cushion system includes a cushion plate supported by a fluid cylinder.

3. A method according to claim 2 wherein the cushion system includes a cushion plate supported by a nitrogen gas fluid cylinder.

4. A method according to claim 1 wherein the cushion system includes a cushion plate supported by a spring having a predetermined spring rate.

5. A method according to claim 1 wherein the step of sealing the metal sheet further includes sealing the sheet between the die members by providing a gas pressure seal operative to prevent gas passing out of the die cavity.

6. A method according to claim 1 further providing a cooling plate to dissipating excess heat and to shield the cushion system from the die temperature.

7. An apparatus for shaping a metal sheet into a formed product, the apparatus comprising:

at least two die members operative to move between a first open position and second sealed position such that a die cavity is formed;

a preforming punch disposed upon one of the die members;

cushioning system operative to control the amount of material flow into the die cavity as the metal sheet is formed over the preforming punch;

a blankholder engagable with the cushion system;

a heating platen operative to raise the temperature of the die members to a predetermined level;

a source of gas pressure and passages for directing the gas pressure into the die cavity; and wherein said cushioning system exerts a force on the metal sheet holding the metal sheet in place and permitting controlled material flow into the die until the second sealed position is reached.

8. An apparatus as defined in claim 7 further including a cooling plate capable of dissipating excess heat and shielding the cushion system from high temperatures.

9. An apparatus as defined in claim 7 wherein the cushion system further includes a cushion pin and a cushion plate.

10. An apparatus as defined in claim 9 wherein the cushion system further includes a fluid cylinder.

11. An apparatus as defined in claim 10 wherein the fluid cylinder contains nitrogen.

12. An apparatus as defined in claim 9 wherein the cushion comprises a spring having a predetermined spring rate.

13. An apparatus as defined in claim 7 further including shims operative to change the level of the preforming punch relative to the second sealed position thereby increasing or decreasing the amount of preform.

14. An apparatus as defined in claim 7 wherein the two die members are operative to form a seal when positioned in the second sealed position, the seal being operative to prevent gas from passing therebetween.

15. An apparatus as defined in claim 14 wherein the seal is further operative to prevent further material flow into the die cavity.

* * * * *